US006340562B1

(12) United States Patent
Taima

(10) Patent No.: US 6,340,562 B1
(45) Date of Patent: Jan. 22, 2002

(54) SILVER HALIDE PHOTOGRAPHIC EMULSION AND SILVER HALIDE PHOTOGRAPHIC LIGHT-SENSITIVE MATERIAL

(75) Inventor: Yasuo Taima, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/248,080

(22) Filed: Feb. 10, 1999

(30) Foreign Application Priority Data

Feb. 17, 1998 (JP) ..... 10-034703

(51) Int. Cl.[7] ..... G03C 1/015; G03C 1/047

(52) U.S. Cl. ..... 430/599; 430/567; 430/569; 430/607

(58) Field of Search ..... 430/567, 569, 430/599, 607

(56) References Cited

U.S. PATENT DOCUMENTS 4,233,398 A * 11/1980 Nittel et al. ..... 430/495
5,026,632 A * 6/1991 Bagchi et al. ..... 430/545
5,318,888 A * 6/1994 Weberg et al. ..... 430/569
5,556,738 A * 9/1996 Takamuki et al. ..... 430/526
5,741,633 A * 4/1998 Whitson et al. ..... 430/531
5,972,588 A * 10/1999 Nabeta ..... 430/569

OTHER PUBLICATIONS

Science and Technology of Photography VCH Publishers, NY, NY. Kanheinz Keller p. 56, 1993.*

* cited by examiner

*Primary Examiner*—Janet Baxter
*Assistant Examiner*—Amanda C. Walke
(74) *Attorney, Agent, or Firm*—Jordan B. Bierman; Bierman, Muserlian and Lucas

(57) ABSTRACT

A silver halide photographic emulsion, wherein silver halide grains are prepared by adding a compound capable of forming cross-linkage with gelatin to said silver halide grains in any of processes before the completion of chemical sensitization after the formation of the silver halide grains.

19 Claims, No Drawings

SILVER HALIDE PHOTOGRAPHIC EMULSION AND SILVER HALIDE PHOTOGRAPHIC LIGHT-SENSITIVE MATERIAL

FIELD OF THE INVENTION

The present invention relates to a silver halide photographic emulsion and a silver halide photographic light-sensitive material with high sensitivity, low fog and excellent pressure resistance.

BACKGROUND OF THE INVENTION

Recently, with regard to development processing of silver halide light sensitive photographic materials, there have been demands for further reduction of the processing time and disposal of processing effluent.

In the field of medical use, for example, the amount of time for X-ray photographing is rapidly increasing due to increased use of X-rays for diagnosis and inspection in general medical examinations, as well as increased popularity of periodical health check-ups and clinical surveys. Accordingly, it have been strongly desired to reduce the processing time and disposal of processing effluent.

In response to demand for rapid access for the silver halide photographic light-sensitive material, it is necessary to reduce the processing time of development, fixation, washing and drying. When subjected to rapid processing, pressure to the silver halide photographic light-sensitive material caused by a transferring roller and caused by contacting with a transferring guide becomes larger. Therefore, it is necessary to enhance pressure resistance characteristic of the silver halide photographic light-sensitive material to meet the rapid processing.

With respect to the known methods to enhance the pressure resistance characteristic, there have been a method of employing high iodide content silver halide layer and providing electron trapping capability by occluding a metallic ion in the interior of silver halide grain and a method of increasing an amount of binder in an emulsion layer to reduce the pressure to silver halide grain. However, high iodide content silver halide layer and increased amount of binder lead to lowering processing capability and are not sufficient from the viewpoint of enhancing the pressure resistance characteristic in rapid processing access.

With silver halide grains of a smaller size which is sensitized, the pressure resistance characteristic is improved. However, with reduction sensitization, selenium sensitization and tellurium sensitization etc., increased sensitization is accompanied with increased fog, so that further improvement is sought.

SUMMARY OF THE INVENTION

An object of the present invention is to provide the silver halide photographic light-sensitive material with enhanced sensitivity and reduced fog and capable of being processed in rapid processing.

DETAILED DESCRIPTION OF THE INVENTION

Above object of the invention could be attained by the following constitution:

(1) A silver halide photographic emulsion comprising silver halide grains prepared by adding a compound capable of forming cross-linkage with gelatin to said silver halide grains before the completion of chemical sensitization after the formation of the silver halide grains.

(2) The silver halide photographic emulsion of item 1, wherein the compound capable of forming cross-linkage with gelatin is a high molecular compound.

(3) The silver halide photographic emulsion of item 1, wherein said silver halide grains are prepared by adding an oxazoline type high molecular compound before the completion of chemical sensitization after the formation of the silver halide grains.

(4) The silver halide photographic emulsion of item 1, wherein said silver halide grains are prepared by adding a polysaccharide compound having cross-linkage forming group with gelatin to said silver halide grains before the completion of chemical sensitization after the formation of the silver halide grains.

(5) The silver halide photographic emulsion of item 1, wherein said silver halide grains are subjected to reduction sensitization.

(6) A silver halide photographic light-sensitive material comprising a support having thereon a silver halide light-sensitive e emulsion n layer, wherein said silver halide emulsion layer contains the silver halide emulsion of item 1.

(7) The silver halide photographic light-sensitive material of item 6, wherein an amount of gelatin added in the silver halide photographic light-sensitive material is 0.5 to 2.0 g per $m^2$ of one side on the support.

(8) The silver halide emulsion of item 3, wherein the oxazoline type high molecular compound has weight average molecular weight of 10000 to 1000000.

(9) The silver halide emulsion of item 3, wherein the oxazoline type high molecular compound contains a repeating units represented by following formula (1):

Formula (1)

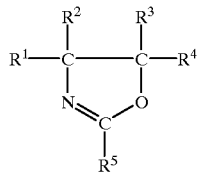

wherein $R^1$, $R^2$, $R^3$ and $R^4$ represent each a substituent group; $R^5$ represents a non-cyclic organic group having an unsaturated bonding group.

(10) The silver halide emulsion of item 9, wherein the substituent group is a hydrogen atom, a halogen atom, an alkyl group, an aralkyl group, an aryl group or an alkoxy group.

(11) The silver halide emulsion of item 9, wherein the oxazoline type high molecular compound is water soluble polymer polymerized by 5 to 50% by weight of a monomer having the repeating unit of formula (1) based on total amount of the monomer and not less than 50% by weight of a hydrophilic monomer based on total amount of the monomer.

(12) The silver halide emulsion of item 9, wherein the oxazoline type high molecular compound is polymer latex polymerized by 5 to 30% by weight of a monomer having the repeating unit of formula (1) based on total amount of the monomer.

(13) The silver halide emulsion of item 4, wherein the polysaccharide compound is dextran, dextrin or cyclodextrin having ring structure.

(14) The silver halide emulsion of item 13, wherein the polysaccharide compound is the cyclodextrin having ring structure.

(15) The silver halide emulsion of item 1, wherein added amount of the compound capable of forming cross-linkage with gelatin is 0.01 to 10 mmol per 1 g of gelatin.

(16) The silver halide emulsion of item 10, wherein added amount of the compound capable of forming cross-linkage with gelatin is 0.01 to 10 mmol per 1 g of gelatin.

(17) The silver halide emulsion of item 15, wherein the added amount is 0.05 to 0.5 mmol per 1 g of gelatin.

A compound capable of forming cross-linkage with gelatin (hereinafter referred to as gelatin cross-linkable compound) is a compound having at least one group capable of forming cross-linkage with gelatin (hereinafter referred to as gelatin cross-linkable group) which react with an amino group and a carboxy group existing in gelatin molecule to form cross-linkage. As gelatin cross-linkable group, are cited aldehyde group, carboxyl group, —NHR (R represents a hydrogen atom or substituents), 2,4-dichloro-6-oxy-s-triazine group, epichlorohydrin group, epibromohydrin group, epifluorohydrin group, epiiodohydrin group, ethylchloroformate group, phenylchloroformate group. active vinyl group, oxazoline group, N-methylol group, acrylamide group, methacrylamide group (one of two hydrogen atoms of a amide group may be substituted), ethyleneimine group, carbodiimide group, and epoxy group, but are preferably cited 2,4-dichloro-6-oxy-s-triazine group and oxazoline group, etc. Above mentioned gelatin cross-linkable compound may possess plural gelatin cross-linkable groups, may be a low molecular compound or a high molecular compound, and may be a monomer or a polymer. Among them, the high molecular compound having repeating unit is preferable, for examples, an oxazoline type high molecular compound and a polysaccharide compound having gelatin cross-linkable groups are preferable.

The oxazoline type high molecular compound according to the invention is a polymer latex containing oxazolines as a monomer unit in it's molecule or a water soluble polymer containing oxazolines as a monomer unit in it's molecule. Weight average molecular weight of the oxazoline type high molecular compound is 10,000 to 1,000,000, preferably 10,000 to 150,000.

The oxazoline containing polymer latex (hereinafter referred to as latex polymer) used in the invention is a polymer having repeating unit of the monomer represented by the following formula (1).

Formula (1)

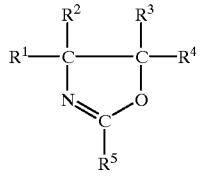

In the formula, $R^1$, $R^2$, $R^3$ and $R^4$ each represent optional substituent groups, specifically are cited a hydrogen atom, a halogen atom, an alkyl group, an aralkyl group, an aryl group (a phenyl group, etc) and an alkoxy group, and the substituents for $R^1$, $R^2$, $R^3$ and $R^4$ described above except the hydrogen atom and the halogen atom can be further substituted. $R^5$ represents a non-cyclic organic group having an unsaturated bonding group capable of addition polymerization.

As exemplified compounds are cited following compounds.

(a) 2-vinyl-2-oxazoline (b) 2-vinyl-4-methyl-2-oxazoline (c) 2-vinyl-5-methyl-2-oxazoline (d) 2-iso-propenyl-2-oxazoline (e) 2-iso-propenyl-4-methyl-2-oxazoline (f) 2-iso-propenyl-5-ethyl-2-oxazoline One kind or mixture of two kinds or more selected from these compounds can be used.

There is no limitation in an using amount of the monomer represented by the formula (1), but it is preferable to use it in an amount of between not less than 5 wt % and not more than 30 wt % of total mixture of monomers in obtaining latex polymer.

The polymer latex containing oxazoline groups can be obtained, for example, by polymerizing the monomer represented by the formula (1) singly, or by copolymerizing the monomer represented by the formula (1) and one or more of an ethylene type unsaturated monomer capable of copolymerization with said monomer. As a monomer capable of copolymerization with said monomer, acrylic acid ester derivative, methacrylic acid ester derivative, vinylester derivative, olefin derivative, diene derivative, acrylamide derivative, methacrylamide acrylamide derivative, vinyl ether derivative and other various ethylene type unsaturated monomer can be used and monomer having two or more ethylene type unsaturated groups can be preferably used. Further, as exemplified compounds of acrylic acid ester derivatives, are cited methylacrylate, ethylacrylate, n-propylacrylate, iso-propylacrylate, n-butylacrylate, iso-butylacrylate, sec-butylacrylate, tert-butylacrylate, amylacrylate, hexylacrylate, 2-ethylhexylacrylate, octylacrylate, tert-octylacrylate, 2-chloroethylacrylate, 2-bromoethylacrylate, 4-chlorobutylacrylate, cyanoethylacrylate, 2-acetoxyethylacrylate, dimethylaminoethylacrylate, benzylacrylate, methoxybenzylacrylate, 2-chlorocyclohexylacrylate, cyclohexylacrylate, furfurylacrylate, tetrahydrofurfurylacrylate, phenylacrylate, 5-hydroxypentylacrylate, 2,2-dimethyl-3-hydroxypropylacrylate, 2-methoxyethylacrylate, 3-methoxybutylacrylate, 2-ethoxyethylacrylate, 2-iso-propoxyethylmethacrylate, 2-butoxyethylacrylate, 2-(2-methoxyethoxy)ethylacrylate, 2-(2-butoxyethoxy) ethylacrylate, ω-methoxypolyethyleneglycolacrylate (number of additional molecules is 9), 1-bromo-2-methoxyethylacrylate, 1,1-dichloro-2-ethoxyethylacrylate. As exemplified compounds of methacrylic acid ester derivatives, are cited methylmethacrylate, ethylmethacrylate, n-propylmethacrylate, iso-propylmethacrylate, n-butylmethacrylate, iso-butylmethacrylate, sec-butylmethacrylate, tert-butylmethacrylate, amylmethacrylate, hexylmethacrylate, cyclohexylmethacrylate, benzylmethacrylate, chlorobenzylmethacrylate, octylmethacrylate, stearylmethacrylate, N-ethyl-N-phenylaminoethylmethacrylate, 2-(3-phenylpropyloxy) ethylmethacrylate, dimethylaminophenoxyethylmethacrylate, furfurylmethacrylate, tetrahydrofurfurylmethacrylate, phenylmethacrylate, cresylmethacrylate, naphthylmethacrylate, 2-hydroxyethylmethacrylate, 4-hydroxybutylmethacrylate, triethyleneglycolmonomethacrylate, dipropyleneglycolmonomethacrylate, 2-methoxyethylmethacrylate, 3-methoxybutylmethacrylate, 2-acetoxyethylmethacrylate, 2-ethoxyethylmethacrylate, 2-iso-propoxyethylmethacrylate, 2-butoxyethylmethacrylate, 2-(2-methoxyethoxy) ethylmethacrylate, 2-(2-butoxyethoxy)ethylmethacrylate and arylmethacrylate. As exemplified compounds of vinyl ester derivatives, are cited vinyl acetate, vinyl propyonate, vinyl butylate, vinyl iso-butylate, vinyl caproate, vinyl chloroacetate, vinyl methoxyacetate, vinyl phenylacetate, vinyl benzoate and vinyl salicylate. As exemplified compounds of conjugated diene monomer derivatives, are cited 1,3-butadiene, isoprene, 1,3-pentadiene, 2-ethyl-1,3-butadiene, 2-n-propyl-1,3-butadiene, 2,3-dimethyl-1,3-butadiene, 2-methyl-1,3-pentadiene, 1-phenyl-1,3-butadiene, 1-α-naphthyl-1,3-butadiene, 1-β-naphthyl-1,3-butadiene, 2-chloro-1,3-butadiene, 1-bromo-1,3-butadiene, 1-chlorobutadiene, 2-fluoro-1,3-butadiene, 2,3-dichloro-1,3-butadiene, 1,1,2-trichloro-1,3-butadiene and 2-cyano-1,3-butadiene. Except for the monomers mentioned above, are cited acrylamide derivatives such as acrylamide, ethylacrylamide, tert-butylacrylamide, cyclohexylacrylamide, benzylacrylamide, hydroxymethylacrylamide, phenylacrylamide, dimethylacrylamide, diethylacrylamide, diacetoneacrylamide, etc.; methacrylamide derivatives such as methacrylamide, ethylmethacrylamide, tert-butylmethacrylamide, benzylmethacrylamide, hydroxymethylmethacrylamide, phenylmethacrylamide, dimethylmethacrylamide, etc.; olefin derivatives such as ethylene, propylene, 1-butene, 1-pentene, vinyl chloride, vinilydene chloride, etc.; styrene derivatives such as styrene, methylstyrene, ethylstyrene, chloromethylstyrene, methoxystyrene, acetoxystyrene, chlorostyrene, dichlorostyrene, bromostyrene, vinylbenzoic acid methyl ester, etc.; vinyl ether derivatives such as methylvinylether, butylvinylether, hexylvinylether, methoxyethylvinylether, etc.; as other exemplified monomers, are cited butyl crotonate, hexyl crotonate, dimethyl itaconate, dimethyl maleate, dibutyl maleate, diethyl fumarate, dimethyl fumarate, methyvinylketone, phenylvinylketone, methoxyethylvinylketone, N-vinylpyrrolidone, acrylonitrile, methacrylonitrile, methylenemalonirile, vinylidene chloride, acrylic acid, methacrylic acid, itaconic acid, maleic acid, maleic acid anhydride, vinylsulfonic acid, 2-acrylamide-2-methylpropanesulfonic acid, styrenesulfonic acid, etc. To prepare the latex according to the invention, monomers having at least two unsaturated ethylene groups capable of copolymerization can be used. As exemplified monomers of them, are cited divinylbenzene, ethyleneglycol diacrylate, ethyleneglycol dimethacrylate, diethleneglycol diacrylate, diethyleneglycol dimethacrylate, triethyleneglycol diacrylate, triethyleneglycol dimethacrylate, trivinylcyclohexane, trimethylol propanetriacrylate, trimethylol propanetrimethacrylate, pentaerythritol triacrylate, pentaerythritol methacrylate, pentaerythritol tetraacrylate, pentaerythritol tetramethacrylate, etc. The above mentioned monomers may be used singly or in combination of two or more kinds to be copolymerized. From the viewpoint of easiness of polymerization, among the above mentioned monomers, acrylic acid ester derivative, methacrylic acid ester derivative, vinylester derivative, conjugated diene derivative, styrene derivative and a monomer having two or more ethylene type unsaturated groups can be preferably used.

Although the latex polymer used in the invention can be prepared according to known methods, emulsion polymerization method is the most preferable.

In the emulsion polymerization method, the latex polymer used in the invention can be synthesized by using monomer dropping method, multistage polymerization method and method, etc.

An aqueous soluble resin dispersion solution usable in the invention can be obtained according to the method described in Japanese Patent Publication Open to Public (hereinafter referred to as JP-A) No. 2-99537, reference example No. 1.

The composition of the above mentioned oxazoline type polymer latex according to the invention will be mentioned below, but is not limited thereto.

| Exemplified No. | Composition of oxazoline type polymer | Composition ratio (wt %) |
|---|---|---|
| 1 | MA:St:(a) | 45:45:10 |
| 2 | MA:St:(a) | 30:60:10 |
| 3 | MA:St:(d) | 45:45:10 |
| 4 | MA:St:(d) | 30:60:10 |
| 5 | MA:St:(e) | 40:55:5 |
| 6 | MA:St:(e) | 30:60:10 |
| 7 | EA:St:(a) | 30:55:15 |
| 8 | EA:St:(a) | 45:45:10 |
| 9 | EA:St:(b) | 45:50:5 |
| 10 | EA:St:(d) | 45:45:10 |
| 11 | EA:St:(d) | 30:60:10 |
| 12 | EA:St:(d) | 50:45:5 |
| 13 | EA:St:(f) | 45:45:10 |
| 14 | EA:St:(f) | 45:50:5 |
| 15 | EA:St:(f) | 30:65:5 |
| 16 | BA:St:(b) | 40:55:5 |
| 17 | BA:St:(c) | 40:55:5 |
| 18 | BA:St:(d) | 20:70:10 |
| 19 | BA:St:(d) | 35:60:5 |
| 20 | BA:St:(d) | 45:45:10 |
| 21 | BA:St:(d) | 50:40:10 |
| 22 | BA:St:(e) | 45:45:10 |
| 23 | BA:St:(e) | 30:60:10 |
| 24 | MMA:EA:(d) | 30:65:5 |
| 25 | AN:BA:(a) | 50:30:20 |
| 26 | AN:BA:(a) | 45:45:10 |
| 27 | AN:St:(d) | 45:50:5 |
| 28 | AN:St:(d) | 30:50:20 |

MA: Methyl acrylate, EA: Ethyl acrylate, BA: Butyl acrylate, MMA: Methyl methacrylate, AN: Acrylonitrile, St: Styrene, (a)–(f): Aforesaid oxazoline monomer capable of addition polymerization.

There are commercially available polymer latexes containing the oxazoline according to the invention in their molecules as a monomer unit and these polymer latexes (such as Epocros K-1010E, K-1020E, K-1030E, K-2010E, K-2020E, K-2030E produced by Nihon Syokubai Co., Ltd.) can easily be obtained.

The aqueous soluble polymer containing oxazoline used in the invention (hereinafter referred to as polymer A) is obtained by polymerization of the monomer represented by the aforesaid formula (1) or, as occasion demands, obtained by copolymerization of the monomer represented by the formula (1) with at least one other kind of monomer.

An using amount of the oxazoline monomer capable of addition polymerization is not limited thereto, but not less 5 wt % of the oxazoline monomer capable of addition polymerization in total amount of all monomers is preferably used in obtaining polymer A. There is no limitation in using other monomers which do not react with oxazoline nucleus but are capable of copolymerization with the oxazoline monomer capable of addition polymerization. As examples of other monomers, are cited (meth)acrylic acid ester derivatives such as methyl (meth)acrylate, butyl (meth)acrylate, 2-ethylhexyl (meth)acrylate, methoxypolyethyleneglycol (meth)acrylate, 2-hydroxyethyl (meth)acrylate, 2-aminoethyl (meth)acrylate and its salt, etc.; unsaturated nitrile derivative such as (meth)acrylonitrile, etc.; unsaturated amide derivatives such as (meth)acrylamide, N-methylol(meth)acrylamide, N-(2-hydroxyethyl) (meth) acrylamide, etc.; vinyl ester derivatives such as vinyl acetate, vinyl propionate, etc.; vinyl ether derivatives such as methyl vinyl ether, ethyl vinyl ether, etc.; a-olefin such as ethylene, propylene, etc.; α,β-unsaturated halogen containing monomers such as vinyl chloride, vinylidene chloride, vinyl fluoride, etc.; α,β-unsaturated aromatic monomers such as styrene, α-methylstyrene, sodium styrenesulfonate, etc. These compounds can be used singly or in combination of two or more kinds.

The polymer A can be prepared by carrying out solution polymerization in an aqueous medium according to known polymerization method in which the oxazoline monomer capable of addition polymerization, if necessary, with at least one other monomer can be polymerized. There is no limitation to use an aqueous medium, as far as it is miscible with water, for examples, water, mixture of water and methyl alcohol, mixture of water and ethyl alcohol, mixture of water and propyl alcohol, mixture of water and iso-propyl alcohol, mixture of water and butyl alcohol, mixture of water and tert-butyl alcohol, mixture of water and ethyleneglycol, mixture of water and ethyleneglycolmonomethylether, mixture of water and ethyleneglycolmonobutylether, mixture of water and diethyleneglycol, mixture of water and acetone, and mixture of water and methylethylketone, etc.

To give an aqueous solution solubility to the polymer A, not less than 50 wt % of composition of all monomers composing the polymer A is preferably occupied with hydrophilic monomers. As exemplified hydrophilic monomers, are cited 2-hydroxyethyl (meth)acrylate, methoxypolyethyleneglycol (meth)acrylate, 2-aminoethyl (meth)acrylate and its salt, (meth)acrylamide, N-methylol (meth)acrylamide, N-(2-hydroxyethyl)-(meth)acrylamide, (meth)acrylonitrile and sodium styrenesulfonic acid, etc.

As the exemplified aqueous solution soluble polymer containing oxazoline according to the invention, are cited Epocros WS-300 and WS-500 (each produced by Nihon Syokubai Co., Ltd.).

In this invention, the above mentioned oxazoline type high molecular compound may be added as a solution form or as a dispersion form.

Polysaccharide compound having cross-linkage group with gelatin is the polysaccharide compound of which hydroxy groups are partially modified with the compounds capable of forming cross-linkage with gelatin. As the exemplified polysaccharide compounds, are preferably cited dextran, dextrin and cyclodexrin having ring structure, specifically preferably cyclodexrin. Weight average molecular weight of polysaccharide compound is preferably 500 to 100,000, more preferably 1,000 to 10,000.

Next, the exemplified cyclodexrins having groups capable of forming cross-linkage with gelatin are shown.

K1 β-cyclodextrin/sodium 2-hydroxy-4,6-dichloro-s-triazine salt (average modified ratio per a molecule is 2.3).

K2 β-cyclodextrin linked with one molecule of maltose/sodium 2-hydroxy-4,6-dichloro-s-triazine salt (average modified ratio per a molecule is 2.3).

K3 β-cyclodextrin/epichlorohydrin (average modified ratio per a molecule is 2.4).

K4 β-cyclodextrin linked with one molecule of maltose/epichlorohydrin (average modified ratio per a molecule is 2.4).

K5 β-cyclodextrin/ethylchloroformate (average modified ratio per a molecule is 2.4).

These compounds can be easily synthesized according to the methods described in German Patent OLS No. 2,357,252, JP-A Nos. 63-83720, 63-168643. According to the synthetic method described below, K1 was synthesized.

(Synthesizing K1)

36.0 g of β-cyclodextrin was dissolved in 500 g of pure water and NaOH was added so that the pH of the resulting solution was adjusted to 8.5. To this solution was added 41.0 g of sodium 2-hydroxy-4,6-dichloro-s-triazine, and the pH of thus obtained solution was adjusted to 8–9 by NaOH. Thus obtained solution was stirred for 5 hours by keeping the temperature of the solution at 15° C. After the obtained reaction mixture was purified, then subjected to spray-dry method to obtain powdery object.

The above mentioned gelatin cross-linkable compound according to the invention may be added after formation of silver halide grain until completion of chemical sensitization. The addition of the gelatin cross-linkable compound can be done once or at plural times, but it is preferable to add it between after desalting until chemical sensitization.

Adding amount of the gelatin cross-linkable compound is preferably 0.01 to 10 mmol per g of gelatin, preferably 0.05 to 0.5 mmol.

Silver halide grain according to the invention includes silver bromide, silver iodobromide, silver chlorobromide, silver chloroiodobromide, silver chloride, silver bromochloride, silver iodochloride and etc. Among them, silver bromide and silver iodobromide are preferable. It is preferable that the silver halide grain contained in the silver halide emulsion used in the invention contains 90 mol % or more silver bromide, more preferably not less than 95 mol %, especially preferably not less than 99 mol %. In the case of silver iodobromide, with respect to the content of silver iodide, the average content ratio of silver iodide in total silver halide grain is preferably 0.01 to 1.0 mol %, more preferably 0.01 to 0.5 mol %.

With regard to the form of silver halide grains used in the invention, it may be cube, octahedron, tetradecahedron, spherical form, tabular form or potato form. Of these are preferred tabular grains.

Next, as a typical example of silver halide grains preferably used in the invention, the tabular grains will be explained in detail.

In the invention, the iodide content of each grain and an average iodide content of overall grains can be determined by means of EPMA (Electron Probe Micro Analyzer). In this method, a sample which is prepared by dispersing silver halide grains so as not to be contact with each other, is exposed to an electron beam to conduct X-ray analysis by excitation with the electron beam. Thereby, elemental analysis of a minute portion can be done. Thus, halide composition of each grain can be determined by measuring intensities of characteristic X-ray emitted from each grain with respect to silver and iodide. At least 50 grains are subjected to the EPMA analysis to determine their iodide contents, from which the average iodide content can be determined.

It is preferred that the tabular silver halide grains contained in the silver halide emulsion according to the invention have more uniformly iodide contents among grains. When the iodide content of grains is determined by the EPMA analysis, a relative standard deviation thereof (i.e., a variation coefficient of the iodide content of grains) is 35% or less, preferably, 20% or less.

In this invention, the tabular silver halide grains may contain silver iodide in the internal portion of the grain. In this case, silver iodide is preferably contained in an amount of 0.01 to 3 mol % in the internal portion of the grain. The halide composition within a silver halide grain can be determined by cutting ultra-thinly slices from the grain and making observation and analysis of the grain by a transmission electron microscope with cooling. Thus, after silver halide grains are taken out from an emulsion, the grains are buried in a resin, which is cut at a thickness of ca. 60 nm with a diamond knife to prepare a slice sample. With cooling with liquid nitrogen, the slice sample is observed and analyzed at various points with a transmission electron microscope provided with an energy-dispersion type X-ray analyzing apparatus to determine the halide composition within the grain (Inoue & Nagasawa, Abstracts of Annual Meeting of The Society of Photographic Science and Technology of Japan, 1987, page 62).

The iodide is present preferably in the outermost surface layer. In this case, the iodide content in the outermost surface layer is preferably between 0.1 mol % and 5 mol %. The iodide content in the outermost surface layer of the tabular silver halide grains refers to a silver iodide content of a portion in a depth from the surface of 50 Å, which can be determined by the XPS method (X-ray Photoelectron Spectroscopy).

Thus, a sample is cooled to −110° C. in super-vacuo of not more than $1\times10^{-8}$ torr. and exposed to MgK α-line, as X-ray for probe, at 15 kV for the X-ray source voltage and 40 mA for the X-ray source current to make measurement with respect to Ag3d5/2, Br3d and I3d3/2 electrons. Measured integral intensity of each peak is corrected with a sensitivity factor and from their intensity ratio, the halide composition of the surface can be determined.

By cooling the sample, measurement errors resulted from destruction of the sample (i.e., decomposition of silver halide and diffusion of halide, specifically, iodide) when exposed to X-ray at room temperature are minimized, resulting in enhanced measurement accuracy. When cooled down to −110° C., sample destruction is minimized to a level which prevents problems in measurement.

An average aspect ratio of the tabular silver halide grains used in the invention is preferably 2 to 10, more preferably not more than 7, especially preferably not more than 5.

In the invention, the tabular grains account for preferably 50% or more of the total grain projected area of the emulsion layer. The tabular grains having (111) major faces account for preferably 70% or more, more preferably 90% or more. The (111) major faces can be identified by X-ray diffractometry.

An average grain diameter of the tabular silver halide grains of the invention is preferably 0.15 to 5.0 μm. more preferably 0.4 to 3.0μ and furthermore preferably 0.4 to 2.0 μm.

An average thickness of the tabular silver halide grains is preferably 0.01 to 1.0 μm, more preferably 0.02 to 0.40 μm and furthermore preferably 0.02 to 0.30 μm.

The grain diameter and thickness can be optimized so as to make best sensitivity and other photographic characteristics. The optimal grain diameter and thickness depend upon sensitivity and other factors affecting photographic characteristics (thickness of a hydrophilic colloidal layer, hardening degree, chemical ripening conditions, designed speed of a photographic material, silver coating amount, etc.).

The tabular silver halide grains used in the invention are preferably monodisperse grains having a narrow grain size distribution. Thus, a width of grain size (diameter) distribution, defined as below, is preferably 20% or less, more preferably 18% or less and furthermore preferably 15% or less:

Width of grain size distribution (%)=(standard deviation of grain size/average grain size)×100.

The tabular silver halide grains used in the invention are preferably those having a narrow grain thickness distribution. Thus, a width of grain thickness distribution, defined as below, is preferably 25% or less, more preferably 20% or less and furthermore preferably 15% or less:

Width of grain thickness distribution (%)=(standard deviation of grain thickness/average grain thickness)×100.

The tabular silver halide grains used in the invention may have dislocation lines. The dislocation lines can be directly observed by use of a transmission type electron microscope at low temperature, as described in J. F. Hamilton, Phot. Sci. Eng., 57 (1967) and T. Shiozawa, J. Soc. Phot. Sci. Japan, 35, 213 (1972). Thus, silver halide grains, which are carefully taken out from an emulsion without applying pressure to an extent of causing dislocation, are placed on a mesh for electron microscopic observation and observed by the transmission method, while being cooled to avoid damage (print out, etc.) due to electron beam. In this case, the more is the grain thickness, the less the transmission of the electron beam, so that clearer observation is achieved by use of a high voltage type electron microscope (not less than 200 kV to the grain thickness of 0.25 μm)

During the grain forming process and/or grain growth process, the tabular silver halide grains employed in the present invention may be subjected to incorporation of at least one metal ion selected from cadmium salts, zinc salts, lead salts, thallium salts, iridium salts (including the complexes), rhodium salts (including the complexes), and iron salts (including the complexes) in the grain interior and/or the grain surface layer.

In this invention, there is no particular limitation on the conditions of the chemical sensitization process, for example, pAg, temperature, time, etc., and the conditions generally employed in this industry may be employed. For chemical sensitization, sulfur sensitization method using sulfur containing compounds capable of reacting with silver ion and using active gelatin, selenium sensitization method using selenium compounds, tellurium sensitization method using tellurium compounds, reduction sensitization method using reductive compounds, and noble metal sensitization method using noble metals such as gold etc. can be employed singly or in combination of two or more kinds. Among them, selenium sensitization method, tellurium sensitization method and reduction sensitization method are preferably employed.

In the chemical sensitization of the invention, wide range of selenium sensitizers may be employed which are described in U.S. Pat. Nos. 1,574,944, 1,602,592. and 1,623,499; JP-A Nos., 60-150046, 4-25832, 4-109240, and 4-147250, etc. Useful selenium sensitizers include colloidal selenium, isoselenocyanates (for example, an arylisoselenocyanate, etc.); selenoureas (for example, N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea, etc.); selenoketones (for example, selenoacetone, selenoacetophenone, etc.); selenoamides (for example, selenoacetoamide, N,N-dimethylselenobenzamide, etc.); selenocarboxylic acids and selenoesters (for example, 2-selenopropionic acid, methyl-3-selenobutylate, etc.); selenophosphates (for example, tri-p-triselenophosphates); selenides (for example, diethylselenide, diethyldiselenide, etc.). Especially preferable selenium sensitizers are selenoureas, selenoamides and selenoketones. In thin invention, it is more effective to add these selenium sensitizers in the form of fine solid particle dispersion than to add them in the solution form.

The tellurium sensitization and its sensitization method are disclosed in U.S. Pat. Nos. 1,623,499, 3,320,069, 3,772,031, 3,531,289, and 3,655,394; U.K. Patent Nos. 1,295,462, and 1,396,696; Canadian Patent No. 800,958; and JP-A Nos. 4-204640 and 4-333043. Examples of useful tellurium sensitizers include telluroureas (e.g., N,N-dimethyltellurourea, tetramethyltellurourea, N-carboxyethyl-N,N'-dimethyltellurourea, N,N'-dimethyl-N'-phenyltellurourea), phosphine tellurides (e.g., tributylphosphine telluride, tricyclohexylphosphine telluride, triisopropylphosphine telluride, butyl-diisopropylphosphine telluride, dibutylphenylphosphine telluride), telluroamides (e.g., telluroacetoamide, N,N-dimethyltellurobenzamide), telluroketones, telluroesters and isotellurocyanates. Using method of the tellurium sensitizers follows that of the selenium sensitizers.

Examples of useful gold sensitizers include chloroauric acid, gold thiosulfate, gold thiocyanate, and gold complexes such as complexes of gold and thioureas, gold and rhodanines, and gold and other compounds capable of forming complexes with gold.

Adding amount of the sulfur sensitizer and gold sensitizer, depending on kind of silver halide emulsion, kind of used compound and the condition of ripening, is usually preferably $1\times10^{-4}$ mol to $1\times10^{-9}$ mol per mol of silver halide, more preferably $1\times10^{-5}$ mol to $1\times10^{-8}$ mol.

The silver halide emulsion may be spectrally sensitized by a spectral sensitizing dye. The spectral sensitizing dye is adsorbed to silver halide grains and contributes to sensitization. It is preferred that when the sensitizing dye represented is allowed to be adsorbed to silver halide emulsion grains and its reflection spectrum is measured, the maximum absorption wavelength of J-band is not more than 555 nm. In application of the spectral sensitizing dye relating to the invention to X-ray photographic materials for medical use which employ a phosphor emitting green light, when the dye is allowed to be adsorbed to silver halide emulsion grains and its reflection spectrum is measured, J-band is formed preferably in the same wavelength region as the green light emitted from the phosphor. Thus, it is necessary to select a spectral sensitizing dye so as to form the J-band having an absorption maximum in a range of 520 to 555 nm, preferably 530 to 553 nm and more preferably, 540 to 550 nm.

The spectral sensitizing dye according to the invention is added during chemical ripening process and preferably added at the beginning of chemical ripening process. By adding the spectral sensitizing dye between the stage of formation of protrusion of silver halide of the silver halide emulsion according to the invention and completion of desalting process, high sensitive silver halide emulsion with an excellent spectral sensitizing efficiency is obtained. Further, to add additionally the same spectral sensitizing dye as added at the aforesaid stage (between the stage of formation of protrusion of silver halide and completion of desalting process) or other spectral sensitizing dye according to the invention at any stage after completion of desalting process through chemical ripening process just before coating process may be allowed.

As a support used in the light-sensitive material according to the invention, are cited ones described in Research Disclosure (abbreviated as RD), RD-17643 on page 28 and RD-308119 on page 1009.

As an appropriate support, is cited plastic film, etc. The surface of these support may be coated with a subbed layer, or subjected to corona discharge and ultra violet radiation to improve adhesion of coated layer. It is preferable to contain an antistatic agent such as a colloidal sol of tin oxide in the subbed layer.

In the photographic light-sensitive material relating to the invention, enhanced sensitivity and sharpness and superior processability can be achieved by providing, on both sides of the support, a silver halide emulsion layer and a cross-over light cutting layer. The total amount of gelatin used in the silver halide emulsion layer, a surface protective later and other layer(s) on one side of the support is preferably 0.5 to 3.5 g/m$^2$, and more preferably 1.5 to 3.0 g/m$^2$.

In preparing the silver halide photographic light-sensitive material, as a protective colloid and as a binder of other hydrophilic colloidal layer, gelatin is advantageously used, but other hydrophilic colloid can be used. The examples of the hydrophilic colloid include gelatin derivatives, grafted polymers by reacting gelatin with other polymers, proteins such as albumin or casein, cellulose derivatives such as hydroxycellulose, carboxymethylcellulose or cellulose sulfate, saccharide derivatives such as sodium alginate or starch derivatives and various synthetic hydrophilic polymers being single polymers or copolymers such as polyvinyl alcohol, polyvinyl alcohol partial acetal, poly-N-vinyl pyrrolidone, polyacrylic acid, polymethacrylic acid, polyacryl amide, polyvinyl imidazole or polyvinyl pyrazole. As gelatin, besides limed gelatin, acid processed gelatin and enzyme treated gelatin described in Bull. Soc. Sci. Photo. Japan No. 16 on page 30 (1966) may be used, and hydrolysate or enzyme decomposition of gelatin can be also used.

The silver halide emulsion used in the invention is preferably washed for desalting and dispersed in a newly prepared protective colloid. The temperature of washing is preferably 5 to 50° C. and the pH of washing is preferably 2 to 10, more preferably 3 to 8 and the pAg of washing is preferably 5 to 10. As a washing method, an appropriate method can be selected from a noodle washing method, a dialysis method using semipermeable membrane, a centrifuge method, an aggregation precipitation method and an ion-exchange method. The aggregation precipitation method is carried out by using sulfuric acid method, organic solvent method, aqueous soluble polymer method, or gelatin derivative method. It might be effective to add the chalcogenide compound described in U.S. Pat. No. 3,772,031 during preparing silver halide emulsion. The preparation of silver halide emulsion may be carried out in the presence of S, Se, Te, cyan salt, thiocyan salt, selenocyan salt, carbonate salt, phosphate salt or acetic acid salt.

By adding a dyestuff capable of decolorization or leaching out of the light-sensitive material in at least any one layer which may be a layer containing the silver halide photographic emulsion used in the invention or a layer other than the emulsion layer, enhanced sensitivity and sharpness and less dyestuff stain can be achieved. The dyestuff which can absorb desired spectral absorption wavelength depending on kind of the light-sensitive material to eliminate undesirable influence caused by said wavelength can be used to enhance sharpness. Said dyestuff decolorizes or leaches out of the light-sensitive material during developing the light-sensitive material, and at the time of completion of image, it is preferable that coloring is not visually observed.

The dyestuff is substantially insoluble in water at pH of not more than 7 and substantially soluble in water at pH of not less than 8. Adding amount of the dyestuff is variable depending on the degree of sharpness, but is preferably 0.2 to 20 mg/m$^2$, more preferably 0.8 to 15 mg/m$^2$.

A variety of adjuvants may be incorporated to the photographic material in accordance with its purpose. The adjuvants are described in Research Disclosure (RD) 17643 (December, 1978), ibid 18716 (November, 1979), and ibid 308119 (December, 1989). Kinds of compounds described in these RD and described section are shown below.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996-8 | III |
| Desensitizing dye | 23 | IV | | 998 | B |
| Dyestuff | 25–26 | VIII | 649–650 | 1003 | VIII |
| Developing accelerator | 29 | XXII | 648 upper right | | |
| Antifoggant/stabilizer | 24 | IV | 649 upper right | 1006-7 | VI |
| Brightening agent | 24 | V | | 998 | V |
| Surfactant | 26–27 | XI | 650 right | 1005-6 | XI |
| Antistatic agent | 27 | XII | 650 right | 1006-7 | XIII |
| Plasticizer | 27 | XII | 650 right | 1006 | XII |
| Slipping agent | 27 | XII | | | |
| Matting agent | 28 | XVI | 650 right | 1008-9 | XVI |
| Binder | 26 | XXII | | 1009-4 | XXII |
| Support | 28 | XVII | | 1009 | XVII |

In the emulsion layer or other layer of the silver halide photographic emulsion used in the invention, is added developing agent such as aminophenol, ascorbic acid, pyrocatechol, hydroquinone, phenylenediamine or 3-pyrazolidone, etc.

In this invention, latex can be used, but usable latex is preferable to have very few influence or no influence in silver halide photographic material. There are preferably employed photographic latexes comprised of photographically inert surfaces having no interaction with various kinds of photographic additives, that is, the surfaces do not adsorb any dye or dyestuff, resulting in no stain and do not also adsorb any development accelerator or inhibitor, leading to no adverse effects on sensitivity or fog.

Photographic emulsion in which latex is dispersed preferably exhibits less pH dependence, less ionic strength resulting in less aggregation precipitation. Index termed glasstransition point of latex is often used. With higher glasstransition point, latex is harder and it is difficult for latex to function as a buffering agent, on the contrary, with lower glasstransition point, latex tends to act interaction with photographic additives to lead to undesired influence. Therefore, it is difficult to use latex in appropriate composition and in appropriate amount. The latex derived from monomers such as styrene, butadiene and vinilidene is known well. When synthesizing the latex, monomers containing carboxylic acid such as acrylic acid, itaconic acid and maleic acid are introduced, resulting in reducing adverse effects on photographic characteristics, and this type of synthetic method is often attempted. By containing methacrylate unit in the latex obtained in the aforesaid combination, the glasstransition point is properly established according to an used light-sensitive material.

The silver halide photographic light-sensitive material of the invention can be processed by the use of a solid processing composition. In this invention, the solid processing composition is one such as powdered processing composition or solid processing composition in the form of a tablet, a pellet or granules, and optionally treated with moisture proof.

In this invention, the powder is referred to an aggregate comprised of fine crystal particles. The granules is referred to granular material prepared by subjecting the powder to granulating process, having particle sizes of 50–5000 $\mu$m. In this invention, the tablet is one prepared by subjecting the powder or granules to compression-molding to a given form. The silver halide photographic light-sensitive material according to the invention can be continuously processed by supplying the solid processing composition.

The processing composition can be solidified in such a manner that the processing composition in the form of a concentrated solution or fine powder or granules, is mixed with a water soluble bonding agent and then the mixture is molded, or the water soluble bonding agent is sprayed on the surface of temporarily-molded processing composition to form a covering layer.

A preferred tablet-making process is to form a tablet by compression-molding after granulating powdery processing composition. Above mentioned tablet is improved in solubility and storage stability, resulting in the stability of photographic characteristics, compared with the solid processing composition formed by only mixing solid processing components and compression-molding components. Granulation can be performed by the known method, such as rolling granulation, extrusion granulation, compression granulation, grinding granulation, stirring granulation, fluidized bed granulation and spray-drying granulation. It is preferred that the average grain size of the granules is 100 to 800 $\mu$m and preferably 200 to 750 $\mu$m. In particular, 60% or more of the granules is with a deviation of ±100 to 150 $\mu$m. As hydraulic press machine, any conventional compression molding machine, such as a single-engine compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side.

It is further preferred to granulate separately each component, such as an alkali agent, reducing agent and preservative in the above process.

The processing composition in the form of a tablet can be prepared according to methods, as described in JP-A Nos. 51-61837, 54-155038, 52-88025, and British Patent 1,213,808. The granular processing composition can also be prepared according to methods, as described in JP-A Nos. 2-109042, 2-109043, 3-39735 and 3-39739. The powdery processing composition can be prepared according to methods, as described in JP-A No. 54-133332, British Patent 725,892 and 729,862 and German Patent 3,733,861.

In cases where the above mentioned solid processing composition is in the form of tablet, its bulk density is preferably 1.0 to 2.5 g/cm$^3$ from the viewpoint of solubility and the point of effects of the invention. When being not less than 1.0 g/cm$^3$, it is advantageous for strength of the solid composition; and when being not more than 2.5 g/cm$^3$, it is advantageous for solubility. In cases where the composition is in the form of granules or powder, the bulk density is preferably 0.40 to 0.95 g/cm$^3$.

The solid processing composition can be used for photographic processing composition such as developing composition, fixing composition and rinsing composition, but it is especially usable for developing composition from the viewpoint of stabilizing photographic characteristics.

Only a part of processing component in the solid processing composition used in the invention being solidified is included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

It is preferable that all the processing chemicals are solidified and are then replenished to the corresponding processing tanks so as to meet the information on a processing amount. When an amount of replenishing water is required, it is replenished in accordance with an information on a processing amount or another information on the replenishing water control. In this case, the liquids to be replenished to a processing tank can only be replenishing water. In other words, when a plurality of processing tanks are required to be replenished, the tanks for reserving some replenishing liquids can be saved to be only a single tank by making use of replenishing water in common, so that an automatic processor can be made compact in size. In particular for making the automatic processor compact in size, it is preferable to put a water replenishing tank to the outside of the automatic processor.

A preferable embodiment of a solid processing chemical applicable to the invention is that all of an alkali agent, a developing agent and a reducer are solidified when solidifying a developer, and that, when a developer is tableted, the numbers of the tablets may be not more than 4 tablets and, preferably, a single tablet. When the solid processing chemicals are solidified separately into not less than 2 tablets, it is preferable to pack these plural tablets or granules in the same package.

As for the means for supplying a solid processing chemical to a processing tank in the invention, and in the case where the solid processing chemical is of the tablet type, for example, there are such a well-known means as described in Japanese Utility Model OPI Publication Nos. 63-137783/1988, 63-97522/1988 and 1-85732/1989, wherein, in short, any means may be used, provided that at least a function for supplying a tableted chemical to a processing tank can be performed. And, in the case where the solid processing chemical is of the granulated or powdered type, there are such a well-known means such as the gravity dropping systems described in JP-A Nos. 62-81964/1987, 63-84151/1988 and 1-292375/1989, and the screw system described in JP-A Nos. 63-105159/1987 and 63-84151/1988. However, the invention shall not be limited to the above-given well-known means.

Among them, however, a preferable means for supplying a solid processing chemical to a processing tank is such a means, for example, that a prescribed amount of a solid processing chemical is weighed out in advance and is then separately packed and the package thereof is opened and the chemical is then taken out of the package so as to meet the quantity of light-sensitive materials to be processed. To be more concrete, every prescribed amount of a solid processing chemical and, preferably, every amount for a single replenishment is sandwiched between at least two packing materials constituting a package. When separating the package into two directions or opening a part of the package, the solid processing chemical can be ready to take out thereof. The solid processing chemical ready to be taken out thereof is readily be supplied to a processing tank having a filtration means by naturally dropping the chemical. The prescribed amounts of the solid processing chemicals are each separately packed respectively in a tightly sealed package so as to shut off the open air and the air permeability to any adjacent solid processing chemicals. Therefore, the moisture resistance can be secured unless the packages are opened.

In an embodiment of the invention, it may be to have a constitution in which a package comprising at least two packing materials sandwiching a solid processing chemical therebetween is brought into close contact with or made adhered to the peripheries of the solid processing chemical on each of the contacting surfaces of the two packing materials so as to be separable from each other, if required. When each of the packing materials sandwiching the solid processing chemical therebetween is pulled each to the different directions, the close contacted or adhered surfaces are separated from each other, so that the solid processing chemical can be ready to take it out.

In another embodiment of the invention, it may be to have the following constitution. In a package comprising at least two packing materials sandwiching a solid processing material therebetween, at least one of the packing materials thereof can be ready to open the seal by applying an external force. The expression, "to open a seal", stated herein means that a packing material is notched or broken off as a part of the packing material remains unnotched or unbroken off. It may be considered to open a seal in such a manner that a solid processing chemical is forcibly extruded by applying a compression force from the side of a packing material subject to be unopened through a solid processing chemical to the direction of a packing material made ready to be opened, or that a solid processing chemical can be ready to take out by notching a packing material subject to be opened by making use of a sharp-edged member.

A supply-starting signal can be obtained by detecting an information on a processing amount. Based on the obtained supply-starting signal, a driving means for separation or opening a seal is operated. A supply-stopping signal can be obtained by detecting an information on the completion of a specific amount of supply. Based on the obtained supply-stopping signal, a driving means for separation or opening a seal is so controlled as to be stopped in operation.

The above-mentioned solid processing chemical supplying means has a means for controlling the addition of a specific amount of the solid processing chemical, that is an essential requirement for the invention. To be more concrete, in an automatic processor of the invention, these means are required to keep every component concentration constant in each processing tank and to stabilize every photographic characteristic.

The term, "an information of the processing amount of silver halide photographic light-sensitive materials", means an information on a value obtained in proportion to an amount of silver halide photographic light-sensitive materials to be processed with a processing solution, to an amount of silver halide photographic light-sensitive materials already processed or to an amount of silver halide photographic light-sensitive materials being processed, and the values indicate indirectly or directly an amount of a processing chemical reduced in a processing solution. The values may be detected at any point of time before and after a light-sensitive material is introduced into a processing solution or during the light-sensitive material is dipped in the processing solution. A concentration or concentration variation of a processing solution reserved in a processing tank may further be detected and physical parameters such as pH and specific gravity may also be detected. An amount discharged to the outside after a processing solution is dried up may also be detected.

A solid processing composition of the invention may be added to any position inside a processing tank and, preferably, to a position communicated with a section for processing a light-sensitive material and circulating a processing solution between the processing tank and the processing section. It is also preferable to have such a structure that a certain amount of processing solution can be circulated therebetween so that a dissolved component can be moved to the processing section. It is further preferable that a solid processing chemical is added to a thermostatically controlled processing solution.

The developing solution used in the invention can contain a sulfite and other organic reducing agent as a preservative, and a chelating agent and a metabisulfite adduct of hardener. The developing solution may contain an antisilver-slugging agent. The developing solution may also contain a cyclodextrin such as compounds described in JP-A No. 1-124853.

Processing temperature of the developing solution is preferably 25 to 50° C., more preferably 30 to 40° C. Developing time is preferably 3 to 15 sec., more preferably 3 to 10 sec. The overall processing time (Dry to Dry) in this invention is not more than 30 sec., preferably not more than 25 sec. The overall processing time means the time including concretely all time periods for steps of developing, fixing, washing and drying.

Replenishment of the processing solution is carried out to compensate the exhaustion of processing agent caused by processing the light-sensitive material and oxidizing the processing agent by air. With respect to the replenishing methods, there are ones such as the replenishing method carried out according to width and transport speed described in JP-A No. 55-126243, the replenishing method carried out according to replenished area described in JP-A No. 60-104946, and the replenishing method carried out according to replenished area controlled by the sheet number of continuous processing described in JP-A No. 1-149156. Preferable replenishing amount (developing solution) is not more than 14 ml/10×12 inch$^2$, more preferable amount is not more than 7 ml/10×12 inch$^2$.

Temperature and time of fixation are each preferably 20 to 50° C. and 2 to 8 sec. Preferable fixing solution contains generally used fixing agents known in the art. Iodide content in the fixing solution is preferably not more than 0.3 g/l, more preferably not more than 0.1 g/l. pH of the fixing solution is not less than 3.8, preferably 4.2 to 5.5. Preferable replenishing amount of the fixing solution is not more than 14 ml/10×12 inch$^2$, more preferable amount is not more than 7 ml/10×12 inch$^2$. Acidic hardening can be done in the fixing solution. In this case, aluminum ion is preferably used. Aluminum sulfate, aluminum chloride and potash alum are preferably used.

As occasion demands, the fixing solution contains preservatives such as sulfite and bisulfite, etc., pH buffering agents such as acetic acid and boric acid, etc., various acids such as mineral acid (sulfuric acid, nitric acid), organic acid (citric acid, oxalic acid, malic acid, etc.), hydrochloric acid, etc., pH adjusting agent such as metal hydroxide (potassium hydroxide, sodium hydroxide), etc., and chelating agent having water softening capability.

As fixing accelerating agents, are cited thiourea derivatives described in Japanese Patent Examined Publication No. 45-35754, 58-122535, 58-122536, and thioether derivatives described in U.S. Pat. No. 4,126,459.

EXAMPLES

The present invention is further explained based on example, but embodiments of the present invention are by no means limited to this example.

Example 1

(Preparation of seed emulsion)

A seed grain emulsion 1 was prepared in the following manner.

| | | |
|---|---|---|
| A1 | Ossein gelatin | 24.2 g |
| | Water | 9657 ml |
| | Sodium polypropyleneoxy-polyethyleneoxy-disuccinate (in an aqueous 10% ethanol solution) | 6.78 ml |
| | Potassium bromide | 10.8 g |
| | 10% nitric acid solution | 111 ml |
| B1 | Aqueous 2.5N silver nitrate solution | 2825 ml |
| C1 | Potassium bromide | 841 g |
| | Add water to make | 2825 ml |
| D1 | An aqueous 1.75N potassium bromide solution | An amount for controlling the following silver potential |

To solution A1, solutions B1 and C1 were each added in an amount of 464.3 ml at 42° C. by making use of a mixing stirrer shown in Japanese Patent Examined Publication Nos. 58-58288 and 58-58289 in a double-jet process by taking 1.5 minutes, so that nucleus grains were formed.

After stopping the addition of solutions B1 and C1, the temperature of solution A1 was raised to 60° C. by taking 60 minutes and the pH thereof was adjusted to be 5.0 by making use of a 3% KOH solution. Thereafter, solutions B1 and C1 were each added thereto again at a flow rate of 55.4 ml/min. for 42 minutes in the double-jet process. At the time for raising the temperature from 42° C. to 60° C. and the time for the subsequent double-jet process carried out with solutions B1 and C1, the silver potential (measured by a silver-ion selection electrode together with a saturated silver-silver chloride electrode as a control electrode) was so controlled as to be +8 mv and +16 mv by making use of solution D1, respectively.

After the completion of the addition, the pH was adjusted to be 6.0 with a 3% KOH solution and a desalting treatment were immediately made. The resulting seed emulsion was proved through an electron microscope as follows. Not less than 90% of the whole projected area of the silver halide grains thereof were comprised of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.064 $\mu$m and 0.595 $\mu$m, respectively. Further, the variation coefficients of the grain thickness and the distance between the twin planes thereof were proved to be 40% and 42%, respectively.

(Preparation of emulsions, Em-1)

By making use of seed emulsion-1 and the following 4 kinds of solutions, silver halide tabular grain emulsion Em-1 was prepared.

| | | |
|---|---|---|
| A2 | Ossein gelatin | 34.03 g |
| | Sodium polypropyleneoxy-polyethyleneoxy-disuccinate (in an aqueous 10% ethanol solution) | 2.25 ml |
| | Seed emulsion-1 | Equivalent to 1.722 mols |
| | Water to make | 3150 ml |

-continued

| | | |
|---|---|---|
| B2 | Potassium bromide | 1734 g |
| | Water to make | 3644 ml |
| C2 | Silver nitrate | 2478 g |
| | Water to make | 4165 ml |
| D2 | A fine-grained emulsion* comprising 3 wt % of gelatin and silver iodide grains (having an average grain-size of 0.05$\mu$) | Equivalent to 0.080 mol |

*To 6.64 liters of an aqueous 5.0 wt % gelatin solution containing 0.06 mol of potassium iodide, 2 liters each of an aqueous solution containing 7.06 mol of silver nitrate and an aqueous solution containing 7.06 mol of potassium iodide were added by taking 10 minutes. In the course of forming the fine grains, the pH was controlled to be 2.0 by making use of silver nitrate, and the temperature was controlled to be 40° C. After completing the grain formation, the pH was adjusted to be 6.0 by making use of an aqueous sodium carbonate solution.

In a reaction vessel, solution A2 was vigorously stirred with keeping the temperature at 60° C. Thereto a part of solution B2, a part of solution C2 and the half amount of solution D2 were each added in a triple-jet process by taking 5 minutes. Thereafter, the half amounts each of the remaining solutions B2 and C2 were added successively by taking 37 minutes, then a part of solution B2, a part of C2, and whole remaining amount of D2 were added successively by taking 15 minutes, finally the whole remaining amount of solutions B2 and C2 were each added by taking 33 minutes. In the above-mentioned courses, the pH and pAg thereof were kept at 5.8 and 8.8 for all the while. Wherein, the flowing rates of solutions B2 and C2 were acceleratedly varied so as to meet the critical growth rate.

After the completion of the adding, thus obtained emulsion was cooled down to 40° C., and desalted by using an ultrafiltration according to known method, thereafter to the emulsion was added an aqueous 10% gelatin solution so that the amount of gelatin is 13 g per mol of silver halide, then the emulsion was stirred at 50° C. for 30 minutes and dispersed again. After the dispersion, the pH and pAg thereof were kept at 5.8 and 8.06 respectively.

When observing the resulting silver halide emulsion through an electron microscope, it was proved to be the tabular-shaped silver halide grains having the average grain-size (converted into the diameter of the corresponding circle, i.e., circle equivalent diameter) of 0.82 $\mu$m, the average thickness of 0.18 $\mu$m, the average aspect ratio of about 4.5 and the grain-size distribution of 18.1%. The average distance between the twin planes of the grains was 0.020 $\mu$m. In the ratio of the distance between the twin planes to the grain thickness, the grains having not lower than 5 thereof were proved to account for 97% (in numbers) of the total tabular-shaped silver halide grains. Those having not less than 10 were proved to account for 49% of the total grains, and those having not less than 15 accounted for 17% thereof.

(Preparing Em-2)

Em-2 was prepared in the same way in which Em-1 was prepared except adding WS-300 (produced by Nihon Syokubai Co., Ltd.) according to the present invention in an amount of 0.3 mmol per 1 g of gelatin in Em-1 just before desalting using ultrafiltration. The shape of the silver halide grains of Em-2 was the same as that of Em-1.

(Preparing Em-3)

Em-3 was prepared in the same way in which Em-1 was prepared except simultaneously adding an aqueous 10% gelatin solution and WS-300 (produced by Nihon Syokubai Co., Ltd.) according to the present invention in an amount of 0.3 mmol per 1 g of gelatin in Em-1. The shape of the silver halide grains of Em-3 was the same as that of Em-1.

(Preparing Em-4)

| | | |
|---|---|---|
| A3 | Ossein gelatin | 75.5 g |
| | Sodium polypropyleneoxy-polyethyleneoxy-disuccinate (in an aqueous 10% ethanol solution) | 6.78 ml |
| | Potassium bromide | 64.7 g |
| | Water to make | 10800 ml |
| B3 | An aqueous 0.7N silver nitrate solution | 470 ml |
| C3 | An aqueous 2.0N silver nitrate solution | 1500 ml |
| D3 | An aqueous 1.3N potassium bromide solution | 410 ml |
| E3 | An aqueous 2.0N potassium bromide solution | An amount for controlling the following silver potential |
| F3 | Ossein gelatin | 125 g |
| | Water to make | 4000 ml |
| G3 | An aqueous 0.01N sodium ethylthiosulfonate solution | 8 ml |
| H3 | A fine-grained emulsion comprising 3 wt % of gelatin and silver iodide grains (having an average grain-size of 0.05$\mu$) | Equivalent to 0.007 mol |

To solution A3, 400 ml of solutions B3 and whole amount of D3 were added at 55° C. by making use of a mixing stirrer shown in Japanese Patent Examined Publication Nos. 58-58288 and 58-58289 in a double-jet process by taking 40 seconds, so that nucleus grains were formed.

The above obtained nucleus silver grains was subjected to chemical ripening by raising the temperature up to 70° C. after adding solution B3 and D3 followed by solution F3. Then remaining solution B3 was added by taking 25 minutes, thereafter by the use of an aqueous 28% ammonia solution, thus obtained silver halide emulsion was subjected to chemical ripening for 10 minutes and the pH was adjusted to 6.0 with acetic acid. Adjusting pAg=7.8, $3.6\times10^{-5}$ moles of thiourea dioxide per a mole of silver of the completed silver halide grains was added for 3 minutes, then thus obtained silver halide emulsion was stirred for 30 minutes at 70° C., thereafter the pH of the emulsion was adjusted to 4.2. Keeping pAg=7.8, solutions C3 and E3 were added in a double-jet process at a suitable adding speed so as to meet the critical growth rate , then at the time when 1250 ml of C3 was added, solution G3 was added. Further, at the same time when addition of solutions C3 was completed, solutions H3 and remaining solution C3 and solution E3 were added in a triple-jet process. After the completion of the addition, the emulsion was cooled down to 40° C., and desalted by the use of ultrafiltration according to known method, thereafter to the emulsion was added an aqueous 10% gelatin solution so that the amount of gelatin is 13 g per mol of silver halide, then the emulsion was stirred at 50° C. for 30 minutes and dispersed again. After the redispersion, the pH and pAg thereof were adjusted to 5.8 and 8.06 respectively. The resulting emulsion was proved through an electron microscope as follows. Not less than 90% of the whole projected area of the silver halide grains thereof were comprised of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.20 $\mu$m and 0.80 $\mu$m, respectively. The distribution of circle equivalent diameter is 15%.

(Chemical ripening)

After thus obtained Em-1, Em-2, Em-3 and Em-4 were raised to 47° C., to each solution was added solid particle dispersion of spectral sensitizing dyes, and after 10 minutes to thus obtained each solution were simultaneously added an aqueous mixed solution of adenine, ammonium thiocyanate, chloroauric acid and sodium thiosulfate and a dispersed solution of triphenylphosphine selenide, after 30 minutes a fine silver iodide grain emulsion was added and the each resulting emulsion was ripened for 2 hours. At the time of completion of ripening, an appropriate amount of 4-hydroxy-6-methyl-1,3,3a,7-tetrazaindene (TAI) as a stabilizer was added. The above mentioned chemical sensitization was carried out by using gelatin cross-linkable compounds according to the present invention, of which kind and added amount and added timing are shown in Table 1.

Spectral sensitization dyes and other additives, and their adding amount are shown below.

| | |
|---|---|
| Spectral sensitizing dye (A) | |
| Sodium 5,5'-dichloro-9-ethyl-3,3'-di-(3-sulfopropyl)oxacarbocyanine anhydride | 390 mg |
| Spectral sensitizing dye (B) | |
| Sodium 5,5'-di-(butoxycarbonyl)-1,1'-diethyl-3,3'-di-(4-sulfobutyl)benzoimidazolo-carbocyanine anhydride | 4 mg |
| Adenine | 10 mg |
| Sodium thiosulfate | 3.3 mg |
| Ammonium thiocyanate | 50 mg |
| Chloroauric acid | 2.0 mg |
| Fine silver iodide grain | equivalent to 5 mmol |
| Dispersed solution of selenium sensitizer | 4.0 mg |
| Stabilizer (TAI) | 1000 mg |

Fine silver halide grain hereof is a fine-grained emulsion comprising 3 wt % of gelatin and silver iodide grains (having an average grain-size of 0.05 μm.).

Solid particle dispersion of the spectral sensitizing dyes was prepared according to the method described in JP-A No. 5-297496, namely, it was obtained by adding a predetermined amount of the spectral sensitizing dyes to water previously adjusted to 27° C. and stirring the mixture at 3500 rpm for 30 to 120 minutes by high speed stirrer (dissolver).

The above mentioned dispersed solution of selenium sensitizer was prepared in the following manner. That is, 120 g of triphenylphosphine selenide was added in 30 Kg of ethylacetate, stirred and completely dissolved at 50° C. On the other hand, 3.8 Kg of photographic gelatin was dissolved in 38 Kg of pure water and to the resulting solution was added 93 g of an aqueous 25 wt. % solution of sodium dodecylbenzenesulfonate. Subsequently, these two solutions were mixed and dispersed for 30 minutes at 50° C. with dispersing blade rotational speed of 40 m/sec. by high speed stirring type dispersing machine having a dissolver of which diameter is 10 cm. After then, ethylacetate was rapidly removed while stirring under a reduced pressure until the residual density of ethylacetate is not more than 0.3 wt %. Thereafter the dispersed solution was diluted with pure water to make 80 Kg in total. Part of thus obtained dispersion was partially sampled for the use for an experimental purpose.

TABLE 1

| Emulsion No. after chemical sensitization | Emulsion No. before chemical sensitization | Gelatin cross-linkable compound: Kind | Additon amount (mmol/g gelatin) | Addion timing | Reduction sensitization | Remarks |
|---|---|---|---|---|---|---|
| A | Em-1 | — | — | — | No | Comp. |
| B | Em-1 | $(CH_2{=}CHSO_2CH_2)_2O$ | 0.3 | Simultaneously with s-dye | No | Inv. |
| C | Em-1 | WS-300 | 0.3 | Simultaneously with s-dye | No | Inv. |
| D | Em-1 | WS-300 | 0.01 | Simultaneously with s-dye | No | Inv. |
| E | Em-1 | WS-300 | 1.5 | Simultaneously with s-dye | No | Inv. |
| F | Em-1 | WS-300 | 0.3 | Simultaneously with selenium compound | No | Inv. |
| G | Em-1 | WS-300 | 0.3 | Simultaneously with fine silver iodide grains | No | Inv. |
| H | Em-1 | WS-300 | 0.3 | Simultaneously with TAI | No | Comp. |
| I | Em-1 | K1 | 0.3 | Simultaneously with s-dye | No | Inv. |
| J | Em-1 | K1 | 0.3 | Simultaneously with fine silver iodide grains | No | Inv. |
| K | Em-1 | K1 | 0.3 | Simultaneously with TAI | No | Comp. |
| L | Em-2 | WS-300 | 0.3 | Before desalting | No | Inv. |
| M | Em-3 | WS-300 | 0.3 | Simultaneously with gelatin solution | No | Inv. |
| N | Em-3 | WS-300 | 0.3 | Simultaneously with gelatin solution | No | Inv. |
| | | | 0.2 | Simultaneously with s-dye | | |
| O | Em-4 | — | — | — | Yes | Comp. |
| P | Em-4 | WS-300 | 0.5 | Simultaneously with s-dye | Yes | Inv. |
| Q | Em-4 | K1 | 0.5 | Simultaneously with s-dye | Yes | Inv. |

Comp.; Comparison, Inv.; Invention, s-dye; sensitizing dye
WS-300; 10% aqueous solution Coating solutions for emulsion layers were prepared by adding later mentioned additives in the above obtained emulsions and at the same time later mentioned coating solution for a protective layer was also prepared. Samples were prepared by simultaneously coating the above obtained two solutions on both side of the support by using two slide-hopper type coaters at a speed of 80 m/min, so that coated amount of silver on one side is 1.6 g/m$^2$ and coated amount of gelatin on one side is to be those shown in Table 2. Thus obtained samples were dried for 2 minutes 20 seconds. As the support, polyethyleneterephthalate film base used for X-ray of thickness of 175 $\mu$m colored in blue of which density was 0.13 was used. The film base was subbed with 10 wt % of concentration of copolymer obtained by coplomerization of three monomers, that is, 50 wt % of glycidylmethacrylate, 10 wt % of methylacrylate and 40 wt % of butylmethacrylate. Adding amount on one side of the silver halide light-sensitive material was shown below.

First layer (Cross-over light shielding layer)

| | |
|---|---|
| Solid particle dispersion of dye (AH) | 180 mg/m$^2$ |
| Gelatin | 0.2 g/m$^2$ |
| Sodium dodecylbenzenesulfonate | 5 mg/m$^2$ |
| Compound (I) | 5 mg/m$^2$ |
| 2,4-Dichloro-6-hydroxy-1,3,5-triazine sodium salt | 5 mg/m$^2$ |
| Colloidal silica (av. size 0.014 $\mu$m) | 10 mg/m$^2$ |

Second Layer (Emulsion layer)

The following additives were added to the emulsion above-described.

| | |
|---|---|
| Compound (G) | 0.5 mg/m$^2$ |
| 2,6-Bis(hydroxyamino)-4-diethylamino-1,3,5-triazine | 5 mg/m$^2$ |
| t-Butyl-catechol | 130 mg/m$^2$ |
| Polyvinyl pyrrolidone (M.W. 10,000) | 35 mg/m$^2$ |
| Styrene-anhydrous maleic acid copolymer | 80 mg/m$^2$ |
| Sodium polystyrenesulfonate | 80 mg/m$^2$ |
| Trimethylolpropne | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica | 0.5 g/m$^2$ |
| Latex (L) | 0.2 g/m$^2$ |
| Dextrin (average M.W. 1000) | 0.2 g/m$^2$ |
| Dextran (average M.W. 40000) | 0.2 g/m$^2$ |
| Gelatin | Appropriate amount |

Third Layer (Protective layer)

| | |
|---|---|
| Gelatin | 0.8 g/m$^2$ |
| Matting agent of polymethyl methacrylate (area-averaged particle size 7.0 $\mu$m) | 50 mg/m$^2$ |
| Formaldehyde | 20 mg/m$^2$ |
| 2,4-Dichloro-6-hydroxy-,1,3,5-triazine sodium salt | 10 mg/m$^2$ |
| Bis-vinylsulfonylmethylether | 36 mg/m$^2$ |
| Latex (L) | 0.2 g/m$^2$ |
| Polyacrylamide (average M.W. 10000) | 0.1 g/m$^2$ |
| Sodium polyacrylate | 30 mg/m$^2$ |
| Compound (SI) | 20 mg/m$^2$ |

-continued

| | |
|---|---|
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}O(CH_2CH_2O)_{11}$—H | 3 mg/m$^2$ |
| $C_8F_{17}SO_2N(C_3H_7)(CH_2CH_2O)_{15}$—H | 2 mg/m$^2$ |
| $C_8F_{17}SO_2N(C_3H_7)(CH_2CH_2O)_4$—$(CH_2)_4SO_3Na$ | 1 mg/m$^2$ |

Latex (L)

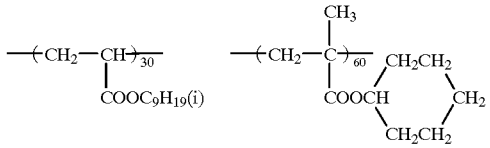

Compound (I)

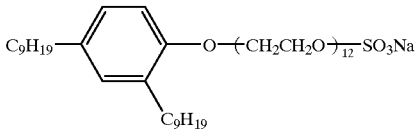

Compound (G)

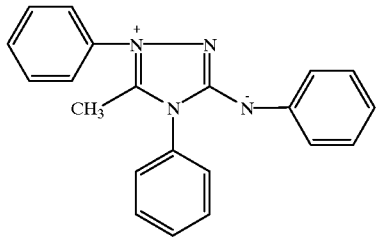

Compound (H)

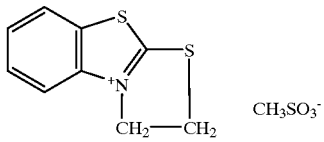

Solid particle dispersion of dye (AH)

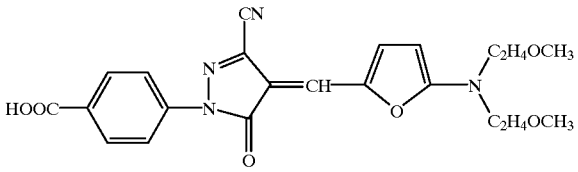

Compound (M)

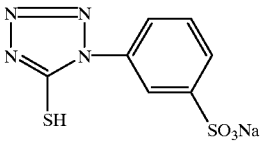

-continued

Compound (N)

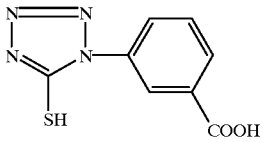

Compound (J)

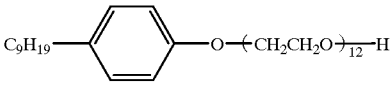

Compound (SI)

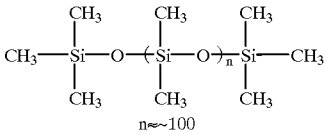

Compound (S-1)

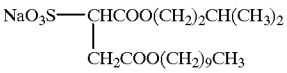

Compound (K)

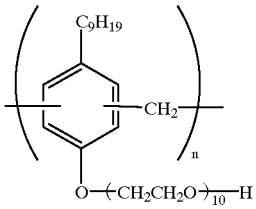

(Mixture of n = 2 to 5)

Compound (0)

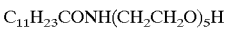

Compound (S-2)

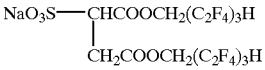

Next, photographic characteristics of the above obtained samples were evaluated. Each sample was sandwiched between two fluorescent intensifying screens XG-S (produced by Konica Co., Ltd.), exposed to X-ray, through an aluminum wedge, at tube voltage of 80 kVp and tube current of 100 mA for 0.05 sec, and processed as follows.

(Developing process)

The following development and fixation were carried out by using an automatic processor (SRX-701 produced by Konica Co., Ltd.). Tablets were produced according to the following operations (A–D).

Operation (A)

3000 g of hydroquinone, as a developing agent was ground into grain until an average grain size became 10 $\mu$m using a commercially available bandom mill. 3000 g of sodium sulfite, 2000 g of potassium sulfite and 1000 g of Dimezone were added to this powder and mixed by the mill for 30 min. After granulating the mixture by adding 30 ml of water at room temperature for 10 min., the granulated product was dried for 2 hours using a fluidized bed dryer at 40° C. to remove moisture contained almost completely. Thus prepared granules was mixed with 100 g of polyethylene glycol 6000 using a mixer for 10 min. in a room conditioned at 25° C. and not more than 40% R.H. Thereafter, the mixture was subjected to compression-molding on a modified tabletting machine, Tough Press Collect 1527 HU, produced by Kikusui Manufacturing Co., Ltd. to prepare tablet A for use as developer-replenisher having weight of 3.84 g per tablet.

Operation (B)

100 g of DTPA, 4000 g of potassium carbonate, 10 g of 5-methylbenzotriazole, 7 g of 1-phenyl-5-mercaptotetrazole, 5 g of 2-mercaptohypoxanthine, 200 g of KOH and N-acetyl-D-L-penicillamine were ground to form granules in a similar manner to the operation (A) with addition of 30.0 ml of water. After granulation, the granules were dried at 50° C. for 30 min. to almost completely remove moisture contained. Thereafter, the mixture was subjected to compression-molding on the above mentioned tabletting machine, to prepare tablet B having a weight of 1.73 g per tablet, for use as developer-replenisher.

Tablets for use as fixer-replenisher were prepared according to the following operations.

Operation. (C)

14000 g of a mixture of ammonium thiosulfate/sodium thiosulfate (70/30 by weight) and 1500 g of sodium sulfite were ground in a similar manner to the operation (A) and mixed using commercially available mixing machine. Adding water of 500 ml, the mixture was granulated in a similar manner to the operation (A). After granulation, the granules were dried up at 60° C. for 30 min. to almost completely remove moisture contained. Thereafter, 4 g of sodium N-lauroylalanine was added to the granules and thus obtained granules were mixed for 3 min. in a room of which temperature and humidity were each adjusted to 25° C. and not more than 40% R.H. Thereafter, the mixture was subjected to compression-molding on the above mentioned tabletting machine, to prepare tablets C having weight of 6.202 g per tablet, for use as fixer-replenisher.

Operation (D)

1000 g of boric acid, 1500 g of aluminum sulfate 18 hydrate, 3000 g of sodium hydrogen acetate (equimolar mixture of glacial acetic acid and sodium acetate) and 200 g of tartaric acid were ground and granulated in a similar manner to the above operation (A). Adding 100 ml of water, the mixture was granulated. After granulation, the granules were dried at 50° C. for 30 min. to almost completely remove moisture contained. Then, 4 g of sodium N-lauroylalanine was added to the granule and thus obtained mixture was mixed for 3 min. Thereafter, the mixture was subjected to compression- molding on the above mentioned tabletting machine to prepare tablet D having weight of 4.562 g per tablet, for use as fixer-replenisher.

Developer Starter:

| | |
|---|---|
| Glacial acetic acid | 2.98 g |
| KBr | 4.0 g |
| Water to make | 1 1iter |

At the start of processing, tablets for developer were dissolved in water to prepare a developer and 330 ml of the starter was added to 16.5 l of the above prepared developer to prepare a starting developer solution. The starting solution was introduced in a developer bath and processing was started. The pH of the developer solution to which was added the starter was 10.45.

Photographic materials prepared as mentioned above were exposed so as to give an optical density of 1.0 and subjected to running-processing. Processing was carried out using an automatic processor, SRX-701 (produced by Konica Co., Ltd.), which was provided with a input member of a solid processing composition and modified so as to complete processing in 15 sec. During running-processing, to the developer solution were added tablets (A) and (B), each 2 tablets and 76 ml of water per 0.62 $m^2$ of the photographic material. When each of the tablets (A) and (B) was dissolved in water of 38 ml, the pH was 10.70. To the fixer solution were added 2 tablets of (C) and 1 tablet of (D) with 74 ml of water per 0.62 $m^2$ of the light-sensitive material. Addition of water was started at the same time of that of the tablets and addition rate of water per each one tablet was kept constant for 10 min. so as to be almost in proportion to a dissolving rate of the solid processing composition.

(Processing condition)

| | | |
|---|---|---|
| Development | 39° C. | 5.0 sec. |
| Fixation | 36° C. | 3.5 sec. |
| Washing | 35° C. | 2.5 sec. |
| Squeezing | — | 1.5 sec. |
| Drying | 50° C. | 2.5 sec. |
| In total | | 15 sec. |

(Evaluation of abrasion mark)

Thus obtained samples were allowed to be preserved under the condition of 80% R.H., at 23° C. for three months, then unexposed samples were scrubbed by a commercially available scrubbing brush made from nylon with load of 100 g/$cm^2$, thereafter thus treated samples were processed and evaluated by visual observation.

Processed samples were visually evaluated, based on the following criteria.

4: Few abrasion marks were observed.

3: A few abrasion marks were observed but acceptable level in practical use.

2: Marked abrasion marks were observed and problem in practical use.

1: Numerous abrasion marks were observed and the density is thick.

(Evaluation of pressure fog (roller mark)

The obtained samples were exposed so that the density of the developed samples was 1.2. The samples were processed for 30 sec. by an automatic processor SRX-701 (produced by Konica Co., Ltd.) of which developing rack and transport rack from development to fixation were intentionally exhausted and processed samples were visually evaluated. Occurrence of unevenness of about 10 $\mu$m caused by the above mentioned intentional exhaustion was observed on overall roller of each rack. Occurrence of numerous fine black spots caused by the rack exhaustion were observed with the samples of which pressure resistance was not acceptable.

Processed samples were visually evaluated, based on the following criteria.

3: No black spot was observed.

2: A few black spots were observed.

1: Numerous black spots were observed.

(Evaluation of preservation)

Sample A was allowed to be preserved under the condition of 40% R.H., at 55° C. for three days, on the other hand, the sample B was allowed to be preserved under the condition of 40% R.H., at 23° C. for three days. Each sample was not exposed, but processed for 30 sec. by the automatic processor SRX-701 (produced by Konica Co., Ltd.) to obtain fog. The difference between the fog density of sample A and that of sample B was obtained. The smaller difference shows more excellent preservation. These results were collectively shown in Table 2.

TABLE 2

| | | Amount of | Sensitometry | | | | Difference of fog | |
|---|---|---|---|---|---|---|---|---|
| Sample No. | Emulsion No. | gelatin g/$m^2$ | Fog | Sensitivity | Abrasion mark | Roller mark | density after preservation | Remarks |
| 1 | A | 1.5 | 0.15 | 100 | 1 | 1 | 0.12 | Comparison |
| 2 | A | 2.5 | 0.15 | 55 | 3 | 2 | 0.08 | Comparison |
| 3 | B | 1.5 | 0.15 | 90 | 3 | 3 | 0.06 | Invention |
| 4 | C | 1.5 | 0.15 | 125 | 4 | 3 | 0.03 | Invention |
| 5 | C | 2.5 | 0.15 | 95 | 4 | 3 | 0.03 | Invention |
| 6 | D | 1.5 | 0.15 | 110 | 3 | 3 | 0.06 | Invention |
| 7 | E | 1.5 | 0.15 | 100 | 4 | 3 | 0.06 | Invention |
| 8 | F | 1.5 | 0.15 | 105 | 4 | 3 | 0.03 | Invention |
| 9 | G | 1.5 | 0.15 | 100 | 3 | 3 | 0.05 | Invention |
| 10 | H | 1.5 | 0.15 | 80 | 2 | 2 | 0.12 | Comparison |
| 11 | I | 1.5 | 0.13 | 115 | 4 | 3 | 0.05 | Invention |
| 12 | J | 1.5 | 0.13 | 105 | 3 | 3 | 0.06 | Invention |
| 13 | K | 1.5 | 0.13 | 76 | 2 | 2 | 0.11 | Comparison |
| 14 | L | 1.5 | 0.15 | 100 | 3 | 3 | 0.06 | Invention |
| 15 | M | 1.5 | 0.15 | 100 | 4 | 3 | 0.06 | Invention |
| 16 | N | 1.5 | 0.15 | 110 | 4 | 3 | 0.03 | Invention |
| 17 | O | 1.5 | 0.21 | 150 | 1 | 1 | 0.28 | Comparison |
| 18 | O | 2.5 | 0.18 | 100 | 2 | 2 | 0.25 | Comparison |
| 19 | P | 1.5 | 0.15 | 150 | 4 | 3 | 0.06 | Invention |
| 20 | Q | 1.5 | 0.15 | 145 | 4 | 3 | 0.08 | Invention |

As can be seen from Table 2, the samples according to the invention showed less lowering of sensitivity, no abrasion mark, no roller mark, and less increased fog caused by preservation.

What is claimed is:

1. A silver halide photographic emulsion comprising silver halide grains prepared by adding an oxazoline type high molecular weight compound capable of forming cross-linkage with gelatin to said silver halide grains before completion of chemical sensitization and after formation of the silver halide grains.

2. The silver halide photographic emulsion of claim 1, wherein said silver halide grains are subjected to reduction sensitization.

3. A silver halide photographic light-sensitive material comprising a support having thereon a silver halide light-sensitive emulsion layer, wherein said silver halide emulsion layer contains the silver halide emulsion of claim 1.

4. The silver halide photographic light-sensitive material of claim 3, wherein an amount of gelatin added in the silver halide photographic light-sensitive material is 0.5 to 2.0 g per $m^2$ of one side on the support.

5. The silver halide emulsion of claim 1, wherein the oxazoline type high molecular compound has weight average moleculer weight of 10,000 to 150,000.

6. The silver halide emulsion of claim 1, wherein the oxazoline type high molecular compound contains a repeating units represented by following formula (1):

Formula (1)

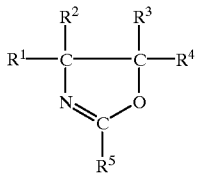

wherein $R^1$, $R^2$, $R^3$ and $R^4$ represent each a substituent group; $R^5$ represents a non-cyclic organic group having an unsaturated bonding group.

7. The silver halide emulsion of claim 6, wherein the substituent group is a hydrogen atom, a halogen atom, an alkyl group, an aralkyl group, an aryl group or an alkoxy group.

8. The silver halide emulsion of claim 7, wherein added amount of the compound capable of forming cross-linkage with gelatin is 0.01 to 10 mmol per 1 g of gelatin.

9. The silver halide emulsion of claim 6, wherein the oxazoline type high molecular compound is water soluble polymer polymerized by 5 to 50% by weight of a monomer having the repeating unit of formula (1) based on total amount of the monomer and not less than 50% by weight of a hydrophilic monomer based on total amount of the monomer.

10. The silver halide emulsion of claim 6, wherein the oxazoline type high molecular compound is polymer latex polymerized by 5 to 30% by weight of a monomer having the repeating unit of formula (1) based on total amount of the monomer.

11. The silver halide emulsion of claim 1 wherein an added amount of said oxaline type high molecular weight compound is 0.01 to 10 m mol per gram of said gelatin.

12. The silver halide photographic emulsion of claim 11 wherein said compound capable of forming cross-linkage with said gelatin is a polysaccharide compound having a cross-linkage forming group capable of forming cross-linkage with said gelatin.

13. The silver halide emulsion of claim 12 wherein said polysaccharide compound is selected from the group consisting of dextran, dextrin and cyclodextrin having a ring structure, each said compound having a cross-linkage group with gelatin.

14. The silver halide emulsion of claim 13 wherein said polysaccharide compound is said cyclodextrin.

15. The silver halide emulsion of claim 1 wherein the added amount is 0.05 to 0.5 mmol per 1 g of gelatin.

16. The silver halide emulsion of claim 11 wherein said high molecular weight compound has a cross-linkage forming group with gelatin which group is selected from the class consisting of aldehyde, carboxyl, —NHR, in which R represents hydrogen or a substituent, 2-4-dichloro-6-oxy-s, triazine, epichlorohydrin, epibromohydrin, epiiodohydrin, epifluorohydrin, ethylchloroformate, phenylchloroformate, active vinyl, oxazoline, N-methylol, acrylamide, methacrylamide, ethyleneimine, carbodiimide, and epoxy.

17. A photographic material comprising a support and, coated thereon, the silver halide photographic emulsion of claim 11.

18. The silver halide emulsion of claim 1 wherein said high molecular weight compound has a cross-linkage forming group with gelatin which group is selected from the class consisting of aldehyde, carboxyl, —NHR, in which R represent hydrogen or a substituent, 2-4-dichloro-6-oxy-s, triazine, epichlorohydrin, epibromohydrin, epiiodohydrin, epifluorohydrin, ethylchloroformate, phenylchloroformate, active vinyl, oxazoline, N-methylol, acrylamide, methacrylamide, ethyleneimine, carbodiimide, and epoxy.

19. A method for preparing a silver halide photographic emulsion comprising forming silver halide grains and performing chemical sensitization, wherein an oxazoline type high molecular weight compound capable of forming cross-linkage with gelatin is added to the silver halide grains before completion of said chemical sensitization and after the formation of said silver halide grains.

* * * * *